US011225830B2

(12) United States Patent
Liu et al.

(10) Patent No.: US 11,225,830 B2
(45) Date of Patent: Jan. 18, 2022

(54) VERTICAL SLIDING WINDOW

(71) Applicant: CHANGCHUN KUOER TECHNOLOGY CO., LTD., Jilin (CN)

(72) Inventors: Kuotian Liu, Jilin (CN); Dapeng Chen, Jilin (CN)

(73) Assignee: CHANGCHUN KUOER TECHNOLOGY CO., LTD., Jilin (CN)

( * ) Notice: Subject to any disclaimer, the term of this patent is extended or adjusted under 35 U.S.C. 154(b) by 168 days.

(21) Appl. No.: 16/485,363

(22) PCT Filed: Mar. 14, 2018

(86) PCT No.: PCT/CN2018/078945
§ 371 (c)(1),
(2) Date: Aug. 12, 2019

(87) PCT Pub. No.: WO2018/166467
PCT Pub. Date: Sep. 20, 2018

(65) Prior Publication Data

US 2019/0360262 A1 Nov. 28, 2019

(30) Foreign Application Priority Data

Mar. 16, 2017 (CN) ..... 201720260875.4

(51) Int. Cl.
*E05F 11/00* (2006.01)
*E06B 7/28* (2006.01)
(Continued)

(52) U.S. Cl.
CPC ..... *E06B 7/28* (2013.01); *E05D 13/12* (2013.01); *E06B 3/44* (2013.01)

(58) Field of Classification Search
CPC ..... E06B 7/28; E05D 13/12; E05D 13/1276; E05D 15/16; E05Y 2900/148; E05Y 2201/654; E05Y 2201/664
(Continued)

(56) References Cited

U.S. PATENT DOCUMENTS 488,294 A * 12/1892 Smelser ..... E05D 13/00 16/198
550,650 A * 12/1895 Smelser ..... E05D 13/00 16/198
(Continued)

FOREIGN PATENT DOCUMENTS

CA 2991504 A1 * 1/2017 ..... E05D 15/16
CN 2554314 Y 6/2003
(Continued)

OTHER PUBLICATIONS

Japanese Notice of Reasons for Refusal (Office Action) for Japanese Patent Application No. 2019550674 dated Aug. 18, 2020.
(Continued)

*Primary Examiner* — Jerry E Redman
(74) *Attorney, Agent, or Firm* — K&L Gates LLP

(57) ABSTRACT

This application provides a vertical sliding window, including horizontal frame side edges, vertical frame side edges, and an opening sash, wherein the opening sash slides up and down along a guide rail on the vertical frame side edge. In addition, the vertical sliding window further includes a balance weight device and a balance weight traction cable. The balance weight device includes an enclosure, a rotating shaft partially disposed within the enclosure, a spiral spring whose two ends are respectively fixedly connected to an inner wall of the enclosure and the rotating shaft, and a cone pulley fixedly connected to the rotating shaft, wherein a tapered surface of the cone pulley is provided with a spiral groove. A lower end of the balance weight traction cable is
(Continued)

fixedly connected to the opening sash, and an upper end thereof is fixedly connected to the cone pulley. When the opening sash moves from bottom to top, an elastic deformational force generated by the spiral spring enables the balance weight traction cable to be gradually wound into the spiral groove, and the elastic deformational force of the spiral spring is gradually reduced. Due to a mutual conversion between elastic potential energy of the spiral spring and gravitational potential energy of the opening sash, in the vertical sliding window provided in this application, an external acting force for dragging the opening sash to move up and down as well as energy consumption may be reduced.

7 Claims, 8 Drawing Sheets

(51) Int. Cl.
*E05D 13/00* (2006.01)
*E06B 3/44* (2006.01)

(58) Field of Classification Search
USPC ..... 49/360, 445, 394, 395
See application file for complete search history.

(56) References Cited

U.S. PATENT DOCUMENTS 1,599,872 A * 9/1926 Braen ..... E05D 13/1276 16/198
2,010,214 A * 8/1935 Braun ..... E05D 13/1253 16/198
2,320,413 A * 6/1943 Cummings ..... E05F 11/48 16/198
4,392,329 A * 7/1983 Suzuki ..... E05C 17/32 49/356
4,914,780 A * 4/1990 Rogers ..... E05D 13/123 16/16
5,054,162 A * 10/1991 Rogers ..... E05D 13/1276 16/198
5,169,205 A 12/1992 James
5,259,433 A * 11/1993 Cloutier ..... E05D 13/14 160/190
5,784,831 A * 7/1998 Licking ..... E05B 51/02 49/139
7,036,274 B2 * 5/2006 Carrier ..... E05C 9/021 292/160
7,677,961 B2 * 3/2010 DeCastro ..... E05F 15/681 454/56
7,856,757 B2 12/2010 Ozawa
9,003,705 B1 * 4/2015 Solowiej ..... E06B 7/32 49/169
9,163,473 B2 10/2015 Lawrence
10,344,521 B2 * 7/2019 Ben-Arie ..... E05F 15/665
2003/0221370 A1 * 12/2003 Nakano ..... E05F 1/16 49/332
2005/0055881 A1 * 3/2005 Gann ..... E05D 13/14 49/123
2005/0082015 A1 * 4/2005 Altimore ..... E05D 13/1238 160/133
2005/0224193 A1 * 10/2005 Nelzi ..... E05D 13/006 160/188
2010/0115845 A1 * 5/2010 Lago Palacios ..... E05D 15/20 49/128
2014/0150346 A1 * 6/2014 DeBoer ..... E05D 13/14 49/414
2016/0047158 A1 * 2/2016 Raap ..... E05F 15/70 49/31
2017/0002596 A1 * 1/2017 Laird ..... E05D 13/1261
2018/0023333 A1 * 1/2018 Lange ..... E05D 13/1207 49/349
2019/0093414 A1 * 3/2019 Meoni ..... B65B 55/025
2019/0225456 A1 * 7/2019 Bonnell ..... B65H 75/4415
2020/0018110 A1 * 1/2020 Lindley ..... E05F 15/686
2020/0339395 A1 * 10/2020 Kicher ..... B66D 1/60

FOREIGN PATENT DOCUMENTS

CN 201202369 Y 3/2009
CN 201723082 U 1/2011
CN 205422368 U 8/2016
CN 206737699 U 12/2017
GB 1007008 A 10/1965
GB 1039109 A 8/1966
JP S37002984 Y 1/1962
JP S62059779 A 3/1987
JP S62059780 A 3/1987
JP S63127587 U 8/1988
JP 2003003733 A 1/2003
JP 2007204978 A 8/2007
JP 2009228285 A 10/2009
JP 2010242491 A 10/2010
JP 2012162188 A 8/2012
WO WO-2009035607 A1 * 3/2009 ..... E05F 15/668

OTHER PUBLICATIONS

International Search Report for Application No. PCT/CN2018/078945, dated Jun. 4, 2018 (6 pages).
Japanese Notice of Reasons for Refusal (Office Action) for Japanese Patent Application No. 2019550674 dated Apr. 27, 2021 (with English Translation).

* cited by examiner

VERTICAL SLIDING WINDOW

This application claims the priority to the Chinese Application No. 201720260875.4, filed with the Chinese Patent Office on Mar. 16, 2017 and entitled "VERTICAL SLIDING WINDOW", which is incorporated herein by reference in its entirety.

FIELD OF THE INVENTION

This application relates to the field of window technologies, and in particular, to a vertical sliding window.

BACKGROUND OF THE INVENTION

A vertical sliding window is a novel window body whose window sash can be opened along a height direction, and is more and more widely used in the field of building construction. The vertical sliding window includes an opening sash, horizontal frame side edges, vertical frame side edges, and an opening device. Guide rails are mounted on the vertical frame side edges. A guide member is mounted on a mating surface of the opening sash with the vertical frame side edge. The guide member is inserted into the guide rail to enable the opening sash to move up and down along the guide rail. The opening device includes a traction cable and a power component. One end of the traction cable is fixedly connected to the opening sash, and the other end is connected to the power component. The power component drives the traction cable to get wound or released, thus controlling the opening sash to move up and down along the guide rail.

With higher demands on applications, the opening sash in the vertical sliding window becomes larger and heavier. To meet requirements in lifting and lowering the opening sash, an opening force and opening power provided by the opening device should also increase accordingly, thus increasing manufacturing and use costs of the vertical sliding window.

SUMMARY OF THE INVENTION

To resolve the problem that an opening force and opening power for opening a movable sash need to be increased due to an increase of the size and weight of the opening sash, this application provides a novel vertical sliding window.

This application provides a vertical sliding window, including horizontal frame side edges, vertical frame side edges, and an opening sash, where the horizontal frame side edges are connected to the vertical frame side edges, a guide rail is disposed on the vertical frame side edge, and the opening sash slides up and down along the guide rail;

the vertical sliding window further includes a balance weight device and a balance weight traction cable;

the balance weight device includes an enclosure, a rotating shaft partially disposed within the enclosure, a spiral spring whose two ends are respectively fixedly connected to an inner wall of the enclosure and the rotating shaft, and a cone pulley fixedly connected to the rotating shaft, wherein a tapered surface of the cone pulley is provided with a spiral groove;

a lower end of the balance weight traction cable is fixedly connected to the opening sash, and an upper end thereof is fixedly connected to the cone pulley; and when the opening sash moves upwardly, an elastic deformational force generated by the spiral spring enables the balance weight traction cable to be gradually wound into the spiral groove, and the elastic deformational force of the spiral spring is gradually reduced.

Optionally, when the opening sash moves upward along the guide rail, the balance weight traction cable is wound into the spiral groove from a cone bottom side to a cone tip side of the cone pulley.

Optionally, a ratio of the elastic deformational force of the spiral spring to a minimum radius of the spiral groove that is wound by the balance weight traction cable is a constant value.

Optionally, one of the opening sash and the vertical frame side edge is provided with a latch, and the other one is provided with a latch hole or a latch slot; and the latch is movably inserted into the latch hole or the latch slot.

Optionally, a latch driving mechanism is further included;

the latch driving mechanism includes a gear, a rack, and a positioning guide member, wherein the gear is engaged with the rack, and the gear rotates to drive the rack to move along the positioning guide member; and the latch is mounted at a free end of the rack.

Optionally, a handle driving the gear to rotate is further included.

Optionally, a driving mechanism and a driving traction cable are further included; and a lower end of the driving traction cable is fixedly connected to the opening sash, and an upper end thereof is connected to the driving mechanism.

Optionally, the balance weight device is mounted on the horizontal frame side edge; and a fixed guide pulley mounted at an edge of the horizontal frame side edge is further included, and the balance weight traction cable is wound onto and extends over the fixed guide pulley so as to change its direction.

The vertical sliding window provided in the embodiments of this application includes a balance weight device and a balance weight traction cable. The lower end of the balance weight traction cable is fixedly connected to the opening sash, and the upper end thereof is fixedly connected to the cone pulley in the balance weight device. When the opening sash moves from bottom to top, a torque generated by an elastic deformational force of the spiral spring that is acted on the rotating shaft is slightly greater than a torque acted on the cone pulley by the balance weight traction cable. Therefore, the rotating shaft rotates to enable the balance weight traction cable to be gradually wound into the spiral groove of the cone pulley. During this process, elastic potential energy of the spiral spring is converted into a portion of the gravitational potential energy of the opening sash. However, when the movable sash moves top to bottom, the situation is contrary to the foregoing process: a torque acted on the cone pulley by the balance weight traction cable is greater than the torque acted on the rotating shaft by the elastic deformational force of the spiral spring, and the gravitational potential energy of the opening sash is converted into the elastic potential energy of the spiral spring. Due to a mutual conversion between the elastic potential energy and the gravitational potential energy, in the vertical sliding window of the present invention, an external acting force for dragging the opening sash to move up and down as well as energy consumption may be reduced.

BRIEF DESCRIPTION OF THE DRAWINGS

The accompanying drawings to be used in the embodiments will be briefly discussed below to more clearly describe the technical solutions of this application. Obviously, persons of ordinary skills in the art can also derive other accompanying drawings according to these accompanying drawings without an effective effort.

1—Window frame, 11—Horizontal frame side edge, 12—Vertical frame side edge, 13—Guide rail, 131—Vertical section, 132—Bending guide section, 2—Opening sash, 21—Handle, 3—Balance weight device, 31—Enclosure, 32—Rotating shaft, 33—Cone pulley, 331—Spiral groove, 34—Spiral spring, 4—Balance weight traction cable, 5—Fixed guide pulley.

DETAILED DESCRIPTION OF THE EMBODIMENTS

The technical solutions in the embodiments of this application are described in detail with reference to the accompanying drawings in the embodiments of this application.

Figure 1:
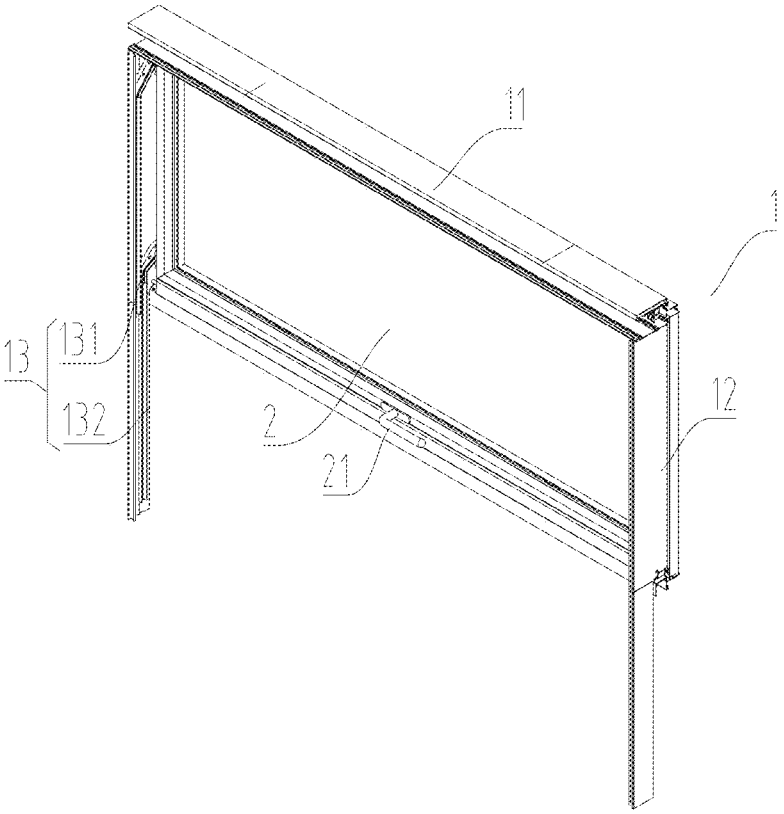
FIG. 1 is an axonometric schematic diagram of a vertical sliding window according to an embodiment of this application.
Figure 1A:
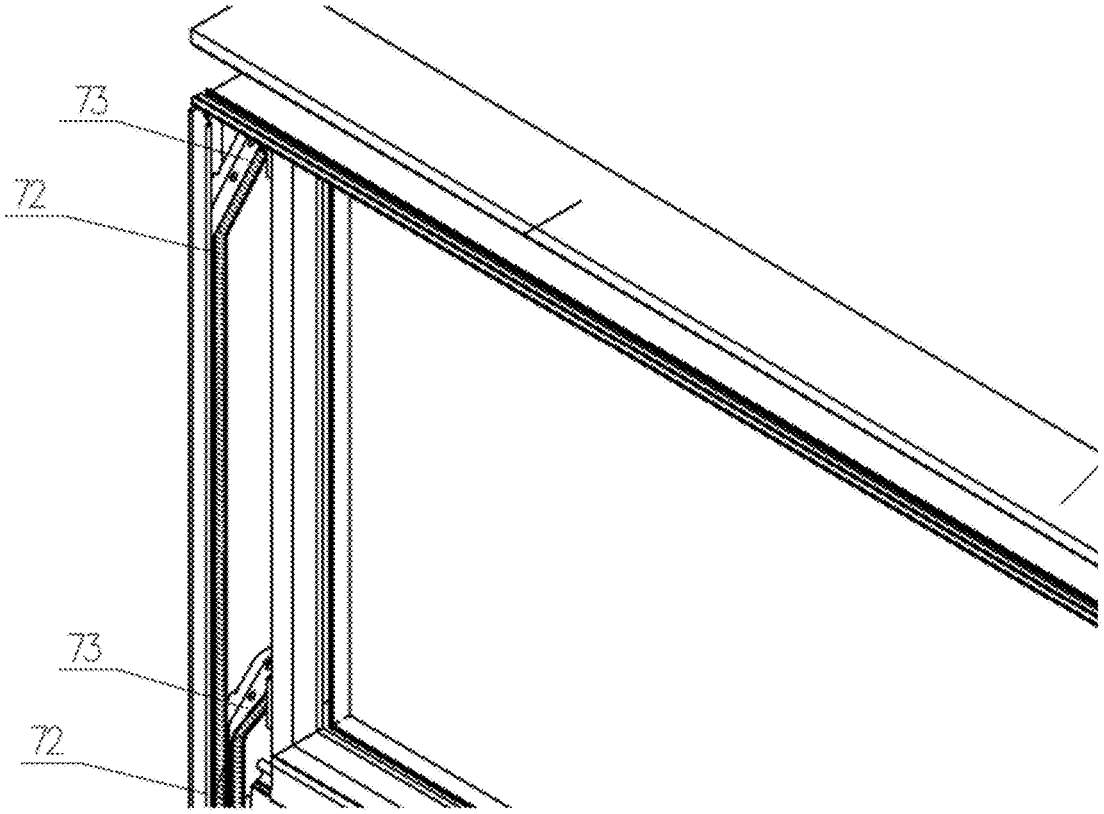
FIG. 1A is a partially enlarged view of FIG. 1, in which a rack is provided, according to an embodiment of this application.
Figure 1B:
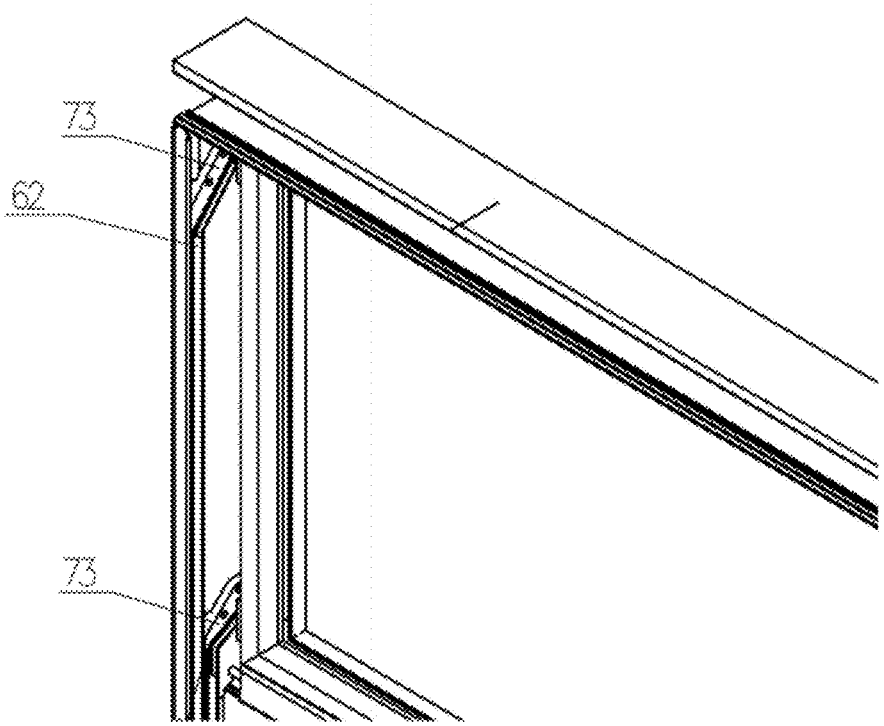
FIG. 1B is view similar to FIG. 1A, in which latch slots are employed instead of rack, according to an embodiment of this application.

FIG. 1 is an axonometric schematic diagram of a vertical sliding window according to an embodiment of this application. As shown in FIG. 1, the vertical sliding window provided in the embodiment of this application includes a window frame 1 and an opening sash 2 arranged in the window frame 1.

The window frame 1 includes horizontal frame side edges 11 and vertical frame side edges 12, where an end portion of the horizontal frame side edge 11 is fixedly connected to an end portion of the vertical frame side edge 12. Guide rails 13 are mounted at an inner side of the vertical frame side edge 12, and a guide member that can be inserted into the guide rail 13 is disposed at a side of the opening sash 2. The guide member fits with the guide rail 13 to enable the opening sash 2 to slide up and down along the guide rail 13.

As shown in FIG. 1, for facilitating opening and closing the opening sash 2, each vertical frame side edge 12 in this embodiment is provided with two guide rails 13. Each guide rail 13 includes a vertical section 131 and a bending guide section 132, where the vertical section 131 is configured to enable the opening sash 2 to slide up and down, and the bending guide section 132 is configured to provide a close fit between the opening sash 2 and the window frame 1.

Figure 2:
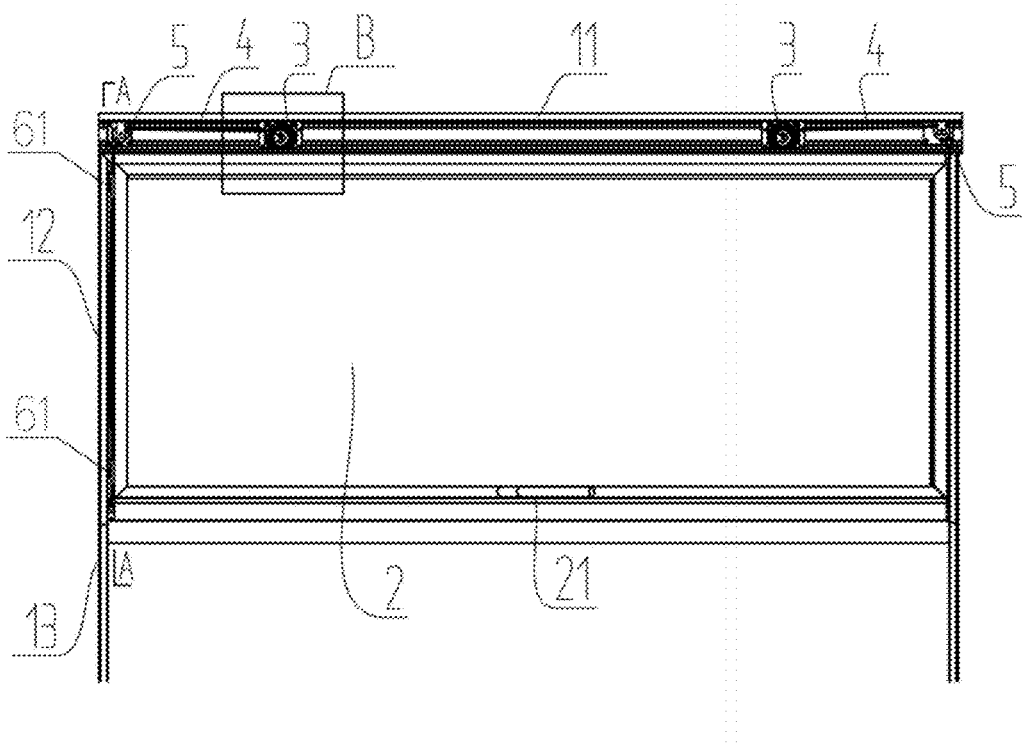
FIG. 2 is a schematic sectional front view of a vertical sliding window according to an embodiment of this application.
Figure 3:
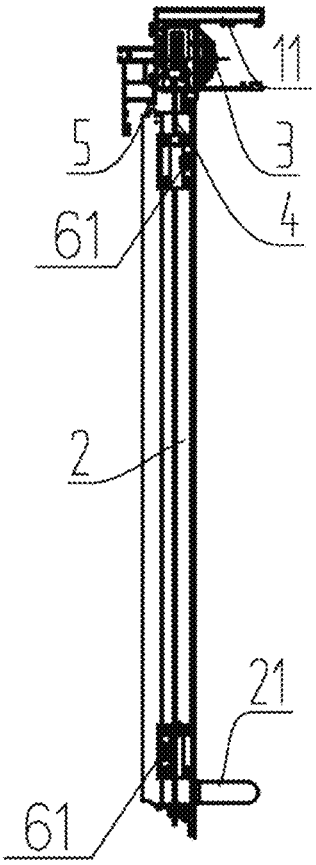
FIG. 3 is a schematic sectional view diagram along A-A in FIG. 2.
Figure 3A:
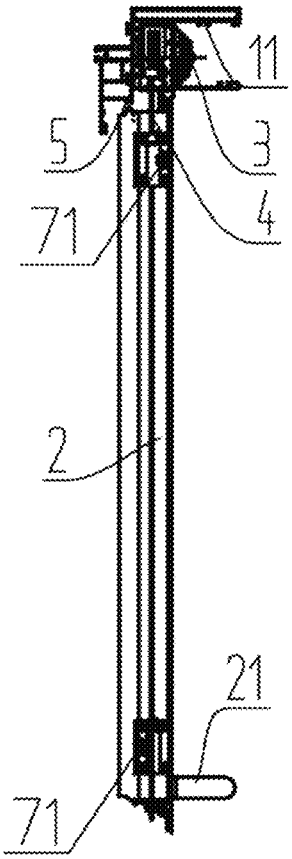
FIG. 3A is view similar to FIG. 3, in which gears are employed instead of latch, according to an embodiment of this application.
Figure 4:
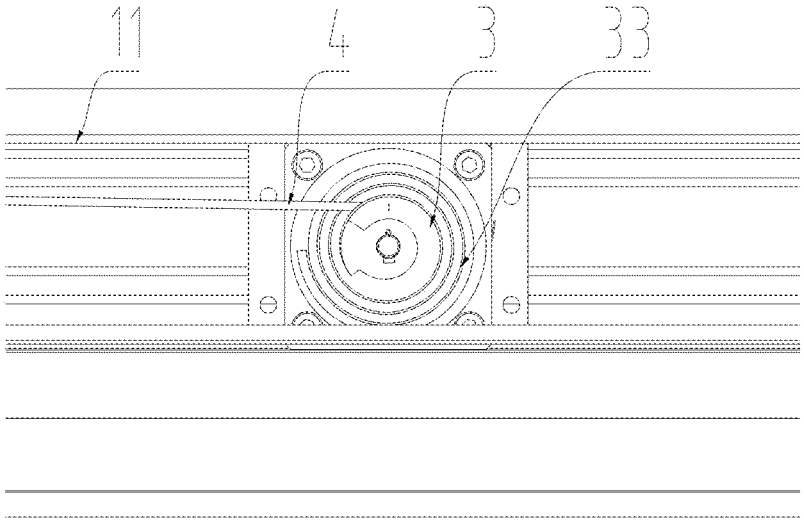
FIG. 4 is an enlarged view of a B region in FIG. 2.

FIG. 2 is a schematic sectional front view of a vertical sliding window according to an embodiment of this application; FIG. 3 is a schematic sectional view diagram along A-A in FIG. 2; and FIG. 4 is an enlarged view of the B region in FIG. 2. As shown in FIG. 2 to FIG. 4, in addition to the foregoing window frame 1 and opening sash 2, the vertical sliding window in this embodiment further includes a balance weight device 3 and a balance weight traction cable 4.

Figure 5:
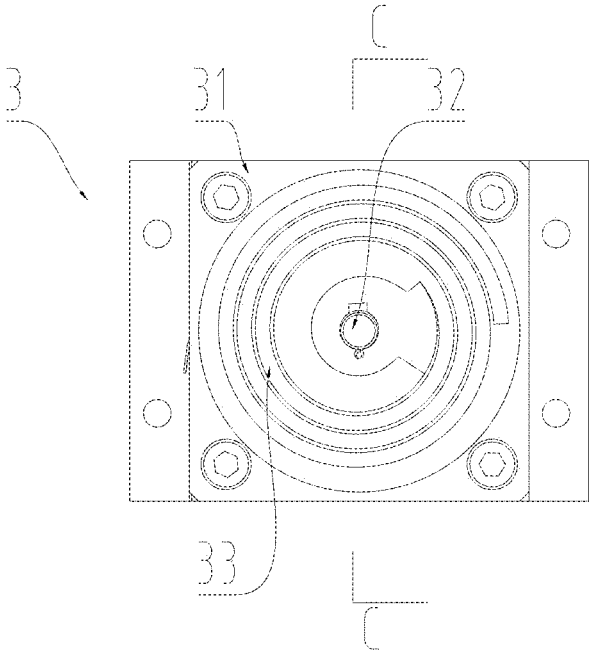
FIG. 5 is a front view of a balance weight device.
Figure 6:
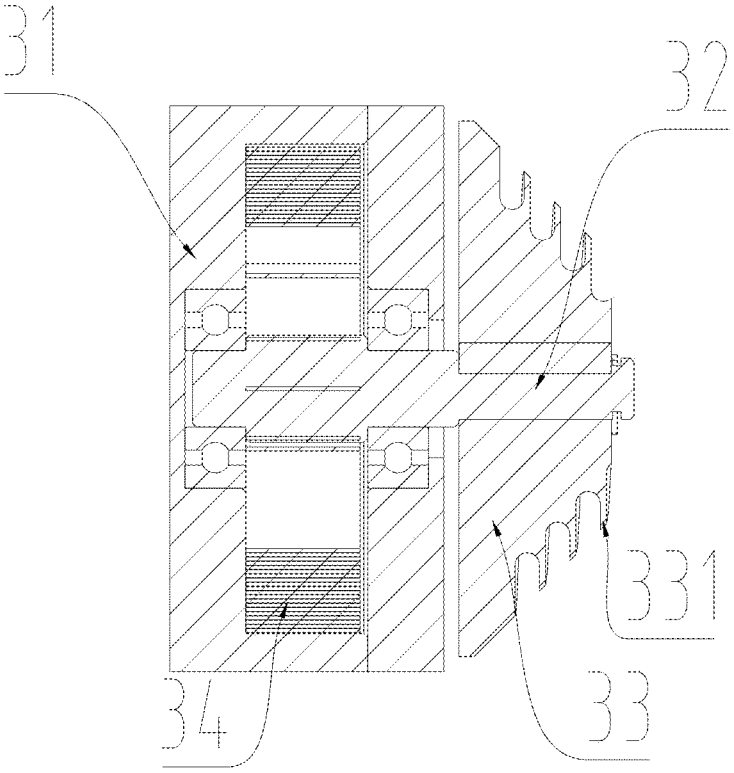
FIG. 6 is a schematic sectional view diagram taken along C-C in FIG. 5.

FIG. 5 is a front view of the balance weight device; and FIG. 6 is a schematic sectional view diagram taken along C-C in FIG. 5. As shown in FIG. 5 and FIG. 6, the balance weight device 3 in this embodiment includes an enclosure 31, a rotating shaft 32, a spiral spring 34, and a cone pulley 33. The enclosure 31 has an inner hollow chamber, a rotating shaft hole is provided on a side wall of the enclosure 31, and a portion of the rotating shaft 32 passes through the rotating shaft hole to be inserted into the inner hollow chamber of the enclosure 31. An axial region of the cone pulley 33 is also provided with a rotating shaft hole. The rotating shaft 32 is inserted into the rotating shaft hole, and is fixedly connected to the cone pulley 33 through a connecting key. When the rotating shaft 32 rotates, the cone pulley 33 may also rotate along with the rotating shaft 32. In addition, a tapered surface of the cone pulley 33 is provided with a spiral groove 331. The spiral spring 34 is mounted in the inner hollow chamber of the enclosure 31. One end of the spiral spring 34 is fixedly connected to an inner side wall of the enclosure 31, and the other end of the spiral spring 34 is fixedly connected to a portion of the rotating shaft 32 that is located within the enclosure 31.

As shown in FIG. 3, a lower end of the balance weight traction cable 4 is fixedly connected to the opening sash 2, and an upper end of the balance weight traction cable 4 is fixedly connected to the cone pulley 33 in the balance weight device 3; and the balance weight traction cable 4 is wound within the spiral groove 331 of the cone pulley 33.

A principle of how to reduce power consumption for opening the vertical sliding window by using the balance weight device 3 in the embodiments of this application is explained below.

In this embodiment, an elastic deformational force by the spiral spring 34 that is acted on the rotating shaft 32 tends to wind the balance weight traction cable 4 onto the rotating shaft 32. When the opening sash 2 moves from bottom to top, the elastic deformational force of the spiral spring 34 generates a certain torque on the rotating shaft 32. This torque cooperates with an external force, and gets slightly greater than a torque acted on the cone pulley 33 by the balance weight traction cable 4. The rotation of the rotating shaft 32 makes the balance weight traction cable 4 be gradually wound into the spiral groove 331 of the cone pulley 33. During this process, the elastic deformational force of the spiral spring 34 is gradually reduced, and the elastic potential energy of the spiral spring 34 is converted into a portion of gravitational potential energy of the opening sash 2 via the rotating shaft 32, the cone pulley 33, and the balance weight traction cable 4.

When the opening sash 2 moves downward along the guide rail 13, the torque acted on the cone pulley 33 by the balance weight traction cable 4 is slightly greater than the torque acted on the rotating shaft 32 by the spiral spring 34, such that the rotating shaft 32 rotates to enable the balance weight traction cable 4 to be gradually unwound from the spiral groove 331. During this process, a portion of the gravitational potential energy of the opening sash 2 is converted into the elastic potential energy of the spiral spring 34 via the balance weight traction cable 4, the cone pulley 33, and the rotating shaft 32.

It may be conceived that by means of an energy conversion between the elastic potential energy of the spiral spring 34 and the gravitational potential energy of the opening sash 2, an external acting force for pulling the opening sash 2 to move up and down is reduced, thereby saving external energy consumption.

As stated above, as the opening sash 2 moves upward, the elastic deformational force of the spiral spring 34 is gradually reduced, so that the torque acted on the rotating shaft 32 by the spiral spring 34 is also gradually reduced. To enable the balance weight traction cable 4 to be well wound onto the cone pulley 33 even in a case where the elastic deformational force is gradually reduced, in this embodiment, during a process in which the opening sash 2 moves upward, the balance weight traction cable 4 gradually moves from a cone bottom of the cone pulley 33 to a cone tip of the cone pulley 33, and meanwhile is wounded within the spiral groove 331 all the time. It is understood that because the balance weight traction cable 4 gradually moves from a cone bottom side to a cone tip side of the cone pulley 33, an arm of force acted on the cone pulley 33 by the balance weight traction cable 4 is also gradually reduced. Therefore, the torque acted on the cone pulley by the balance weight traction cable 4 is also gradually reduced, and accordingly, torsional moment that needs to be overcome by the spiral spring 34 is also gradually reduced.

In this embodiment, at all moments, a ratio of the torque acted on the rotating shaft 32 by the spiral spring 34 to a minimum radius of the spiral groove 331 wound with the balance weight traction cable is a constant value. It may be understood that because an arm of force acted on the rotating shaft 32 by the spiral spring 34 keeps constant, and a pulling force acted on the cone pulley 33 by the balance weight traction cable 4 keeps constant, the spiral spring 34 may pull the balance weight traction cable 4 with an unchanged/constant force when the ratio of the torque acted on the rotating shaft 32 by the spiral spring 34 to the minimum radius of the spiral groove 331 wound with the balance weight traction cable is a constant value; a gravity force of the opening sash 2 that needs to be overcome by an external force is also constant, thus the external force may be constant, too.

In some actual application situations, the vertical sliding window is manually opened. In this case, the torque acted on the rotating shaft 32 by the spiral spring 34 is smaller than the torque acted on the cone pulley 33 by the balance weight traction cable 4, therefore, the vertical sliding window may slide down to be fully opened in most cases. To avoid this problem, in the vertical sliding window provided in this embodiment of this application, a latch 61 is further provided on the opening sash 2, and latch holes or latch slots 62 are disposed on the vertical sliding window at intervals. When the opening sash 2 moves to a predetermined position, the latch 61 on the opening sash 2 may be pushed to be inserted into a corresponding latch hole 62, so that the opening sash 2 is fixed with respect to a movable sash.

Certainly, in other embodiments, the function of positioning/fastening the opening sash 2 may also be realized by providing a latch 61 on the vertical frame side edge 12 and providing latch slots or latch holes 62 on the opening sash 2.

In the embodiments, the latch 61 is provided at an inner side of a lower frame of the opening sash 2 that faces the vertical frame side edge 12. The latch slot or the latch hole 62 is provided at a side of the vertical frame side edge 12 that faces the opening sash 2. Further, the opening sash 2 is further provided with a latch driving mechanism. Optionally, the latch driving mechanism may include a gear 71, a rack 72, and a positioning guide member 73. The gear 71 is engaged to the rack; and when the gear 71 rotates, the rack 72 may be driven to move along the guide member. The latch 61 is mounted at a free end of the rack 72, and therefore, the latch 61 can extend or withdraw within the latch slot/latch hole by controlling a rotation of the gear 71. Certainly, in other embodiments, the latch driving mechanism may be of another type, and details thereof will not be not described herein.

Further, in the embodiments of this application, the opening sash 2 further includes a handle 21 that drives the gear 71 to rotate. In actual application, an operator may control the latch 61 and drive the opening sash 2 to move up and down by using the handle 21.

In some other practical applications, the vertical sliding window is automatically opened. Specifically, the vertical sliding window includes a driving mechanism and a driving traction cable, where a lower end of the driving traction cable is fixedly connected to the opening sash 2, and an upper end of the driving traction cable is connected to the driving mechanism. An opening position of the opening sash 2 is determined by a locking state of the driving mechanism. It may be understood that because the driving mechanism and the driving traction cable lift/lower the opening sash 2 by overcoming the gravity force, an automatic rising of the opening sash 2 may be avoided by a design that the torque acted on the rotating shaft 32 by the spiral spring 34 should be smaller than the torque acted on the cone pulley 33 by the balance weight traction cable 4.

As shown in FIG. 2, in this embodiment, a fixed guide pulley 5 is mounted at an edge of the horizontal frame side edge 11, and the balance weight traction cable 4 is fixedly connected to the cone pulley 33 in the balance weight device 3 after being wound onto and extending over the fixed guide pulley 5.

As shown in FIG. 2, the vertical sliding window provided in this embodiment includes two balance weight devices 3 that are both mounted on the horizontal frame side edge 11. In other embodiments, the number of the balance weight devices is not limited to two, and the balance weight devices are not limited to be mounted on the horizontal frame side edge; as an alternative, it may be mounted on the vertical frame side edge or at other positions of the window body.

The vertical sliding window in the embodiments of this application is described above in detail. Principles and implementations of this application are described in this part with reference to specific embodiments. The foregoing descriptions of the embodiments are merely intended to facilitate an understanding the core concept of this application. All other embodiments derived by persons of ordinary skill in the art without departing from the principles of this application and without an inventive effort shall fall within the protection scope of this application.

What is claimed is:

1. A vertical sliding window, comprising horizontal frame side edges (11), vertical frame side edges (12), and an opening sash (2), wherein the horizontal frame side edges (11) are fixedly connected to the vertical frame side edges (12), a guide rail (13) is disposed on the vertical frame side edge (12), and the opening sash (2) slides up and down along the guide rail (13);

the vertical sliding window further comprises a balance weight device (3) and a balance weight traction cable (4);

the balance weight device (3) comprises an enclosure (31), a rotating shaft (32) partially disposed within the enclosure (31), a spiral spring (34) whose two ends are respectively fixedly connected to an inner wall of the enclosure (31) and the rotating shaft (32), and a cone pulley (33) fixedly connected to the rotating shaft (32), wherein a tapered surface of the cone pulley (33) is provided with a spiral groove (331);

a lower end of the balance weight traction cable (4) is fixedly connected to the opening sash (2), and an upper end of the balance weight traction cable is fixedly connected to the cone pulley (33); and when the opening sash (2) moves from bottom to top, an elastic deformational force generated by the spiral spring (34) enables the balance weight traction cable (4) to be gradually wound into the spiral groove (331), and the elastic deformational force of the spiral spring (34) is gradually reduced, and wherein a ratio of the torque by the spiral spring (34) that is acted on the rotating shaft (32) to a minimum radius of the spiral groove (331) that is wound by the balance weight traction cable (4) is a constant value.

2. The vertical sliding window according to claim 1, wherein when the opening sash (2) moves upward along the guide rail (13), the balance weight traction cable (4) is wound into the spiral groove (331) from a cone bottom side to a cone tip side of the cone pulley (33).

3. The vertical sliding window according to claim 1, wherein one of the opening sash (2) and the vertical frame side edge (12) is provided with a latch (61), and the other of the opening sash (2) and the vertical frame side edge (12) is provided with a latch hole or a latch slot (62); and the latch (61) is movably inserted into the latch hole or the latch slot (62).

4. The vertical sliding window according to claim 3, further comprises a latch driving mechanism, wherein the latch driving mechanism comprises a gear (71), a rack (72), and a positioning guide member (73), wherein the gear (71) is engaged with the rack (72), and the gear (71) rotates to drive the rack (72) to move along the positioning guide member (73); and the latch (61) is mounted at a free end of the rack (72).

5. The vertical sliding window according to claim 4, further comprises a handle (21) that drives the gear (71) to rotate.

6. The vertical sliding window according to claim 1, further comprises a driving mechanism and a driving traction cable, wherein a lower end of the driving traction cable is fixedly connected to the opening sash (2), and an upper end of the driving traction cable is connected to the driving mechanism; and the driving mechanism drives the opening sash (2) to slide up and down along the guide rail (13) via the driving traction cable.

7. The vertical sliding window according to claim 1, wherein the balance weight device (3) is mounted on the horizontal frame side edge (11); and a fixed guide pulley (5) mounted at an edge of the horizontal frame side edge (11) is further comprised, and the balance weight traction cable (4) is wound onto and extends over the fixed guide pulley (5) so as to change the direction of the balance weight traction cable (4).

* * * * *